US005615570A

United States Patent [19]

Mitsubayashi et al.

[11] Patent Number: 5,615,570

[45] Date of Patent: Apr. 1, 1997

[54] METHOD FOR BENDING A PIPE AND APPARATUS FOR BENDING THE SAME

[75] Inventors: Masahiko Mitsubayashi, Nagoya; Masazumi Ohnishi, Toyota; Noritaka Miyamoto, Toyota; Keisuke Kadota, Toyota; Tohru Shimada, Toyota; Katsuji Bando, Nagoya, all of Japan

[73] Assignee: Toyota Jidosha Kabushiki Kaisha, Aichi-ken, Japan

[21] Appl. No.: 363,821

[22] Filed: Dec. 27, 1994

[30] Foreign Application Priority Data

| | | | |
|---|---|---|---|
| Dec. 28, 1993 | [JP] | Japan | 5-336473 |
| Mar. 25, 1994 | [JP] | Japan | 6-056245 |

[51] Int. Cl.[6] ..... B21D 7/00

[52] U.S. Cl. ..... 72/298; 72/311; 72/387; 72/449

[58] Field of Search ..... 72/295, 298, 301, 72/306, 307, 311, 217–219, 388, 387, 7, 383, 449

[56] References Cited

U.S. PATENT DOCUMENTS

| | | | |
|---|---|---|---|
| 1,349,219 | 8/1920 | Moore | 72/387 |
| 2,453,868 | 11/1948 | Shaw | 72/7 |
| 2,743,757 | 5/1956 | Terwilliger | 72/219 |
| 2,884,987 | 5/1959 | Shaw | 72/383 |
| 3,408,844 | 11/1968 | Strachauer et al. | 72/150 |
| 4,061,005 | 12/1977 | Kawanami | 72/307 |
| 4,462,237 | 7/1984 | Kauferle | 72/307 |
| 4,890,469 | 1/1990 | Dischler | 72/217 |
| 5,239,853 | 8/1993 | Kutschker | 72/7 |
| 5,351,517 | 10/1994 | Spath | 72/301 |

FOREIGN PATENT DOCUMENTS

| | | | |
|---|---|---|---|
| 226167 | 6/1987 | European Pat. Off. . | |
| 543019 | 8/1922 | France | 72/388 |
| 832536 | 9/1938 | France . | |
| 461237 | 6/1928 | Germany | 72/217 |
| 2546695 | 3/1977 | Germany . | |
| 4310773 | 10/1994 | Germany . | |

*Primary Examiner*—Daniel C. Crane
*Attorney, Agent, or Firm*—Oliff & Berridge

[57] ABSTRACT

The present invention can provide a method and an apparatus for bending a pipe whose bending cross section has reduced compressed ratio, reduced reduction ratio of area and reduced reduction in thickness and in which bending can be conducted at the desired curvature. In the present invention, both edges of the pipe bending portion are arrested and grasped, a center of one bending edge is set to be the axis and a revolution axis is amounted on it, a rotation axis is mounted at a center of the other bending edge and gears are installed on the revolution axis and the rotation axis so as to engage each other so that the driving is driven to the gear on the rotation axis. The rotation axis revolves having the radius to be the distance from the rotation axis to the revolution axis and at the same time the rotation axis rotates on its axis having the radius of the gear in response to the revolution angle. Accordingly, both of the rotational centers of rotation and revolution are existed on the pipe axis and the bending stress is effected on the whole of the bending portion. Therefore, the levels of the tensile force at the bending outside and the compressive force at the bending inside are constantly kept to be a balanced condition. As the result, the problems that the thickness of the pipe bending portion is reduced and that the pipe bending portion is compressed are improved very much.

15 Claims, 5 Drawing Sheets

METHOD FOR BENDING A PIPE AND APPARATUS FOR BENDING THE SAME

BACKGROUND OF THE INVENTION

1. Field of the Invention

The present invention relates to a method and an apparatus for bending a pipe in a semicircle shape without using a circular tool for bending a pipe. The present invention especially relates to a method and an apparatus for bending a a pipe which are useful to work a corrugate tube.

2. Description of the Related Art

The conventional method for bending a pipe is, for example, shown in Japanese Unexamined Patent Publication No. 65419/1990 (Kokai). In this Publication, as shown in the side view of FIG. 7 and the A to A cross-sectional view of FIG. 8, by using a circular coma 2 which forms a processing groove whose outer peripheral surface is inserted by a pipe 5 and whose cross section is semicircle and an outer side arresting tool 4 which forms a processing groove whose bottom is inserted by the pipe 5 and whose cross section is semicircle, one end 1 of the pipe is fixed and at the same time, the the pipe 5 is inserted and fixed into the groove of the coma 2, the groove of the outer side arresting tool 4 and the pipe is rotated as arresting the pipe along the outer periphery of the coma 2 and the pipe is bent. In these figures, 1 denotes the pipe fixing side, 3 denotes the rotation center of outside arresting tool 4, 5 denotes the pipe moving side, 6 denotes the position of the outside arresting tool 4 in the state in which the pipe is bent at the angle of 90°, 7 denotes the pipe position in the state the pipe is bent at the angle of 90°, 8 denotes the position of the outside arresting tool 4 in the state in which the pipe is bent at the angle of 180°, 9 denotes the pipe position in the state in which the pipe is bent at the angle of 180° and 10 denotes the rotation locus of the outside arresting tool 4.

In the conventional method for bending a pipe, it is very difficult to arrest the bent shape continuously in the case in which the cross sectional shape of the material is inhomogeneous (for example, a corrugate tube whose cross sectional shape varies in response to regions). Accordingly the conventional method for bending a pipe is difficult to apply to the above-mentioned material.

In this conventional method, the plastic deformation caused by bending depends on mainly the tensile deformation of the outer side material. Accordingly, the bent outside of the pipe material is extended with processing and the reduction in the thickness at that portion causes the problem especially when the internal pressure is effected on the bending product. Furthermore for the same reason, when the bending is conducted in the case of the radius being small, the outer peripheral portion is not extended to full length and it reaches to the inner peripheral surface and as the result, the ratio in which the bent cross section is compressed and the ratio of reducing area are increased.

There have been various proposals so as to control reduction of the local thickness of pipe wall which is generated at the time of bending a pipe. For example, in the invention for bending a pipe described in Japanese Unexamined Patent Publication No. 290622/1990 (Kokai), the proposal is described as follows. In this invention, a pipe is clamped by using a bending die which is rotatable, a pressure die which is affected by the bending reaction force when the pipe is clamped and bent by the tightening die which is able to revolve round this bending die and a clamping die which is opposite to this pressure die and which clamps the pipe; the pipe which is clamped by the pressure die and the clamping die is moved; and the compressive force is added to the axial direction of the pipe.

On the other hand, with respect to the bending of a corrugate tube, the shape deformation caused by the spreading toward the pipe's axial direction at the convex portion of the pipe occupies almost of the bending deformation. Accordingly, the bending is concentrated on the convex portion of the corrugate tube which was deformed at first and that portion is mainly compressed. Therefore it is impossible to give the desired bending to the corrugate tube.

In order to overcome the above-mentioned problem, a method for bending a corrugate pipe which is described in Japanese Unexamined Patent Publication No. 177261/1993 (Kokai) was proposed. In the invention of this Publication, by using a pipe arresting means provided with opposite surfaces which clamp the plurality of convex portions of the corrugate pipe toward the direction which is perpendicular to the pipe bending surface and the pipe center axis, bending a corrugate pipe is conducted. In this invention, that the bending and compressing are concentrated on a specific convex portion of the corrugate pipe is prevented from being generated and it becomes more easy to bend the convex portion of the corrugate pipe which is not deformed and that the bending of the corrugate pipe is concentrated on the limited part is prevented from being generated.

However in the above-mentioned invention of the apparatus for bending pipe described in Japanese Unexamined Patent Publication No. 290622/1990 (Kokai), compressive force toward the axial direction of the pipe is added at the time of bending a pipe. Therefore, when a corrugate tube is applied to this conventional invention, the corrugate tube may be compressed owing to the addition of the compressive force of the pipe. Accordingly, it is impossible to apply the apparatus for bending a pipe of this invention to a corrugate tube.

Also in the method for bending a pipe described in Japanese Unexamined Patent Publication No. 177261/1993 (Kokai), bending portion is clamped and arrested by the corrugate pipe arresting portion. Therefore, the following problem occurs in this invention: in addition to the fact that the deformation resistance is big, in order to obtain the accurate bending portion having the desired radius of curvature, rather large amount of skill and experience is needed.

SUMMARY OF THE INVENTION

It is a primary object of the present invention to provide a method for bending a pipe (especially a corrugate pipe) and an apparatus for bending the same which solve the above-mentioned problems found in the conventional method for bending.

It is another object of the present invention to provide a method and an apparatus for bending a pipe in which a shrinkage of a corrugate tube is reduced.

It is still another object of the present invention to provide a method and an apparatus for bending a pipe in which the local compression of the bending portion is reduced.

In order to solve the above-mentioned problems, the present inventors tried to analyze the interaction of the bending stress on the pipe in the conventional method for bending a pipe. As the result, in the conventional method, a coma is used so that the material shape is locally arrested and processed and furthermore, the rotation center of the outer side arresting and supporting portion is offset to the pipe axis, therefore it was confirmed that reducing the thickness at the bending portion and the compressing of the pipe were brought about. Therefore, the present inventors continue the research concerning the method in which the bending of a pipe is conducted with a pipe axis as the center. As the result, the present inventors noticed that bending a pipe may be resolved into the movement for revolving around the center of the other bending edge setting the center of one of bending edge as the axis and the the movement for rotating on its axis setting the center of the other bending edge as the axis. Accordingly, when the pipe is bent, the present inventors came up with an idea that these revolution movement and rotation movement may be given at the same time and completed the present invention.

When the pipe is bent in a semicircle shape, the outline of the method for bending a pipe of the present invention comprises steps of: arresting and grasping the both edges of pipe bending portion; setting one bending edge as the center and revolving around the center of the other bending edge; and at the same time, in response to the revolution angle, rotating on its axis setting the center of the other bending portion as the axis.

Namely, the method for bending a pipe in the present invention comprises the steps of: arresting and grasping both edges of a pipe bending portion; and revolving around the other bending edge setting a center of one of the bending edge as an axis and at the same time rotating on its axis setting the center of the other bending edge as an axis in response to the revolution angle. In the above-mentioned rotation process, the ratio of revolution angular velocity to rotation angular velocity ranges from 1:1.5 to 1:2.5. In many cases, the ratio of revolution angular velocity to rotation angular velocity preferably should be 1:2.

The radius of revolution can be set to be constant. As the revolution is conducted, the radius of revolution may be reduced. Owing to this, the extent of the pipe extension at the bending portion which is generated at the time of bending of the present invention can be reduced.

Also, the method of the present invention can be applied to bending of a metal pipe whose diameter is constant. The method of the present invention is especially suitable to bend a corrugate pipe whose diameter changes in the axial direction and periodically and a spiral pipe in which the portions having the same radius extends in spiral shape.

The apparatus for bending a pipe of to the present invention comprises: a pair of grasping portion which arrests and grasps both edges of a pipe bending portion; a revolution drive unit which sets a center of the pipe side end face of one of said grasped portion which should be bent to be a revolution center and which revolves the other of the grasped portion; and a rotation drive unit which sets a center of the pipe side end face of the other of the grasped portion which should be bent to be a rotation center and which rotates the other of the grasped portion on its axis.

The above-mentioned revolution drive unit and rotation drive unit comprise: a first external toothed gear having revolution axis which passes through a center of the pipe side end face of one of the grasping portion which should be bent as a central axis; a second external toothed gear having a rotation axis which is parallel to the revolution axis and which passes through a center of the pipe side end face of the other of the grasping edge which engages the first external toothed gear and which should be bent as a central axis; and a rotation drive unit which rotates and drives in the sate in which the second external toothed gear engages the first external toothed gear.

Then, the same gears can be used as the first external toothed gear and the second external toothed gear. If the same gears are used, the ratio of revolution angular velocity to rotation angular velocity may be 2. Also, the diameter of the first external toothed gear and the diameter of the second external toothed gear may be different from each other. Owing to this, the ratio of revolution angular velocity to rotation angular velocity may be changed.

Furthermore, the above-mentioned revolution drive unit can comprises an arm which has the revolution center as a central axis and which has the grasping portion as the other edge and a first motor which rotates the arm around the central axis. And the above-mentioned rotation drive unit may comprise a second motor which is held at the edge of the arm and which rotates the other of the grasping portion. In this case, a control device which controls a rotational speed ratio of the first motor and the second motor to be uniform may be needed. Otherwise, this arm may includes a means for changing length which can change the distance between the central axis and the other edge having the grasping portion.

Furthermore, the above-mentioned revolution drive unit comprises: a X-Y two-dimensional drive unit which can be moved toward two-dimensional directions of X-axis direction and Y-axis direction which is perpendicular to X-axis; and a control portion which controls the X-Y two-dimensional drive unit. As comprised as above ways, the revolution radius may be kept constant by realizing the arbitrary revolution by using the control portion, the distance of the revolution radius may be changed and the revolution radius may be reduced continuously as it is conducted contemporarily with the progress of bending.

The present invention will be hereinafter explained based on FIG. 1 which is a view explaining the outline of bending and FIG. 2 which is an A to A cross-sectional view. At a pipe fixing side 11, a fixed side pipe supporting portion 13 is fixed as being adjacent to a fixing side center of bending edge 15 and at a moving side pipe 12, a moving side pipe supporting portion 14 is fixed being adjacent to a moving side center of bending edge 17.

From this state, setting a fixed side center of bending edge 15 as the center, a moving side pipe supporting portion 14 is revolved in response to the locus of a moving side pipe supporting portion 16 and at the same time, the moving side pipe supporting portion 14 itself is rotated setting a center of bending edge moving side 17 to be the center. Furthermore, the angle of rotation in autorotation and the angle of rotation in revolution are preferably set to be equalized. In that case, the ratio of angular speed of revolution to angular speed of autorotation may become 1 to 2 theoretically. Each of angles of rotation is controlled by a mechanical method or an electric method.

In FIG. 1, 18 denotes a locus of autorotation of the moving side pipe supporting portion 14, 19 denotes the position of the moving side pipe supporting portion in the state in which the pipe is bent at the angle of 90°, 20 denotes the pipe position in the state in which the pipe is bent at the angle of 90°, 21 denotes the position of the moving side pipe supporting portion in the state in which the pipe is bent at the angle of 180° and 22 denotes the pipe position in the state in which the pipe is bent at the angle of 180° respectively.

In the method for bending a pipe according to the present invention, both edges of the pipe bending portion are arrested and grasped, setting the center of one of bending edge to be the axis, one edge revolves around the center of the other bending edge and at the same time, in response to the angle of revolution, setting the center of the other bending edge to be the axis and one edge rotates on its axis.

Therefore, the rotation centers in both of autorotation and revolution exist on the pipe axis and also the bending stress is affected on the whole bending portion. Accordingly, the levels of the tensile force at the bending outside and the compressive force at the bending inside are constantly kept to be balanced condition. As the result, the problems that the thickness of the pipe bending portion is reduced and the pipe bending portion is compressed are improved very much. The method according to the present invention is most suitable to bend a corrugate tube which was hard to be processed by using the original methods especially. However the present method is not limited to be used for bending a corrugate tube.

As in the method according to the present invention, in the case when the movement combining autorotation and revolution is intended to be expressed, two rotational systems are usually necessary and furthermore, the angles of rotation should be controlled synchronously and highly precisely. However in the apparatus for bending a pipe, gears engaging to said revolution axis and autorotation axis mutually and respectively are attached, the driving is given to the gear on the autorotation axis. When the revolution is brought about simultaneously by the engaging of the gear on the revolution axis and the gear on the autorotation axis, only by fixing gear on the revolution axis and by giving the driving force to the gear on the autorotation axis, the autorotation and the revolution can be controlled synchronously and highly precisely in the present apparatus. Accordingly, the present apparatus is very simple and highly reliable.

When the radius of the revolution is fixed, the bending portion is extended. In bending a corrugate pipe, this elongation at the time of bending may solve the problems such as the reduction in thickness and the compression at the pipe bending portion. On the other hand, that the elongation is needed at the time of bending means that the large amount of tensile force may be effected at the time of bending. In the case of a corrugate pipe, the tensile force which is needed for elongation is little, so this may not cause any problems in particular. However, in the case of the pipe whose diameter is constant, this may cause the big problem. In this case, the problem may be solved by shortening the radius of revolution at the time of bending, which is conducted contemporarily with bending.

As explained above, the present invention concerning the method for bending a pipe comprises steps of: arresting and grasping the both ends portion of the portion for bending a pipe; revolving around the other bending end setting the center of one of bending end to be the axis; and at the same time rotating in response to the angle of revolution and setting the center of the other bending end to be the axis. In the present method, the rotation centers in both of autorotation and revolution exist on the pipe axis and also the bending stress is affected whole of the bending portion. Accordingly, the level of the tensile force at the bending outside and the compressive force at the bending inside is constantly kept to be balanced condition. As the result, the problems that the thickness of the pipe bending portion is reduced and the pipe bending portion is compressed are improved very much.

The apparatus for bending a pipe according of the present invention, comprises: a revolution axis which is installed on said revolution center; an autorotation axis which is installed on said autorotation center; and gears which engage to each of these revolution axis and autorotation axis mutually; wherein the driving is given to the gear on the autorotation axis. Otherwise the apparatus for bending a pipe according to the present invention includes a plurality of motors which can control the position wherein the revolution and autorotation are conducted by combining these plurality of motors. As the result, the autorotation axis rotates on its axis as it revolves around the revolution axis and the present method for bending a pipe can be obtained. Furthermore, besides the mechanism portion for bending a pipe, there is provided the pipe supporting portion through which the bending pipe is passed and which can be rotated around the surface being perpendicular to the pipe axis. Therefore, the conditions of equipment concerning the pipe lengths are diminished and it becomes possible to bend a pipe on the desired bending surface to the desired position.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure:

FIG. 9 is a squint-eyed view showing the principal part of the mechanism for bending in the present apparatus;

FIG. 10 is a squint-eyed view showing the principal part of the mechanism for bending in the present apparatus in the state in which a pipe is bent at the angle of 180°;

FIG. 11 is a squint-eyed view showing the principal part of the mechanism for bending in the present apparatus in the state in which a pipe is bent at the angle of 90°;

FIG. 12 is a squint-eyed view showing the whole of one preferred embodiment of the present apparatus for bending a pipe;

FIG. 13 is a squint-eyed view showing details of the mechanism for bending a pipe in the present apparatus for bending a pipe;

FIG. 14 is an enlarged fragmentary squint-eyed view for explaining the exchange of gear pair of the mechanism for bending a pipe in the present apparatus for bending a pipe;

FIG. 15 is a squint-eyed view showing details of a pipe supporting portion in the present apparatus for bending a pipe;

FIG. 16 is a squint-eyed view of the apparatus which is the present apparatus for bending a pipe and which is the apparatus in the preferred embodiment in which revolution and autorotation are conducted by using a plurality of servomotors, and FIG. 17 is a squint-eyed view of the apparatus of the preferred embodiment in which a pipe supporting portion is added to the the apparatus of the preferred embodiment in FIG. 16.

DETAILED DESCRIPTION OF THE PREFERRED EMBODIMENT

Having generally described the present invention, a further understanding can be obtained by reference to the specific preferred embodiment which is provided herein for purposes of illustration only and are not intended to limit the scope of the appended claims.

A preferred embodiment of the present invention will be hereinafter described with reference to the drawings.

Figure 1:
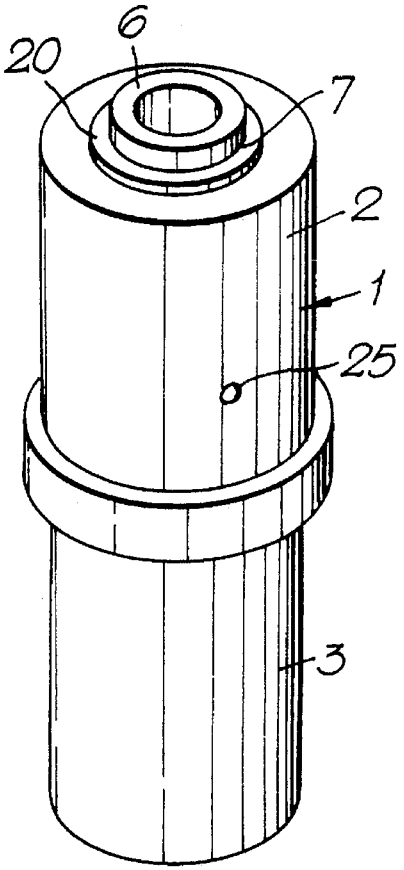
FIG. 1 is an outline figure explaining the method for bending a pipe of the present invention.
Figure 7:
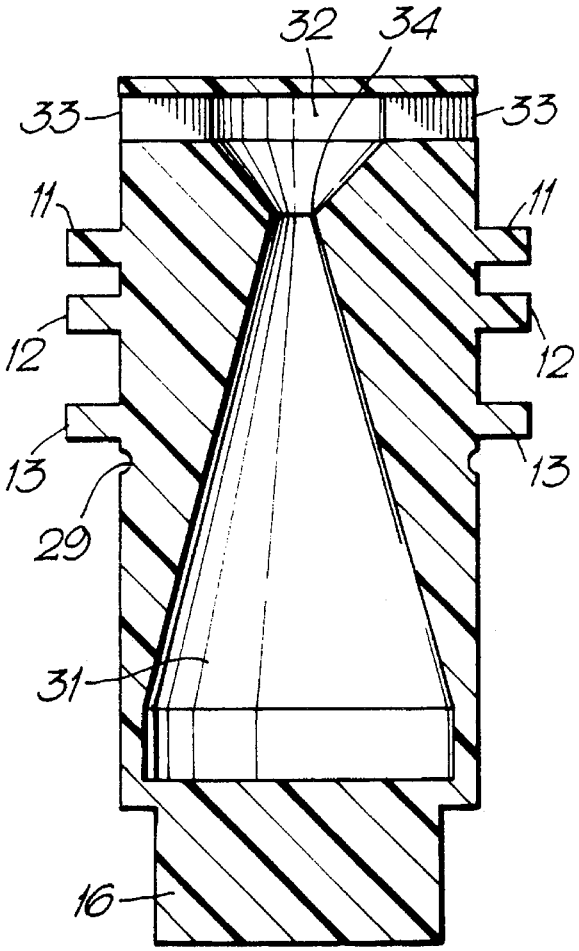
FIG. 7 is a side view explaining the conventional method for bending a pipe.
Figure 2:
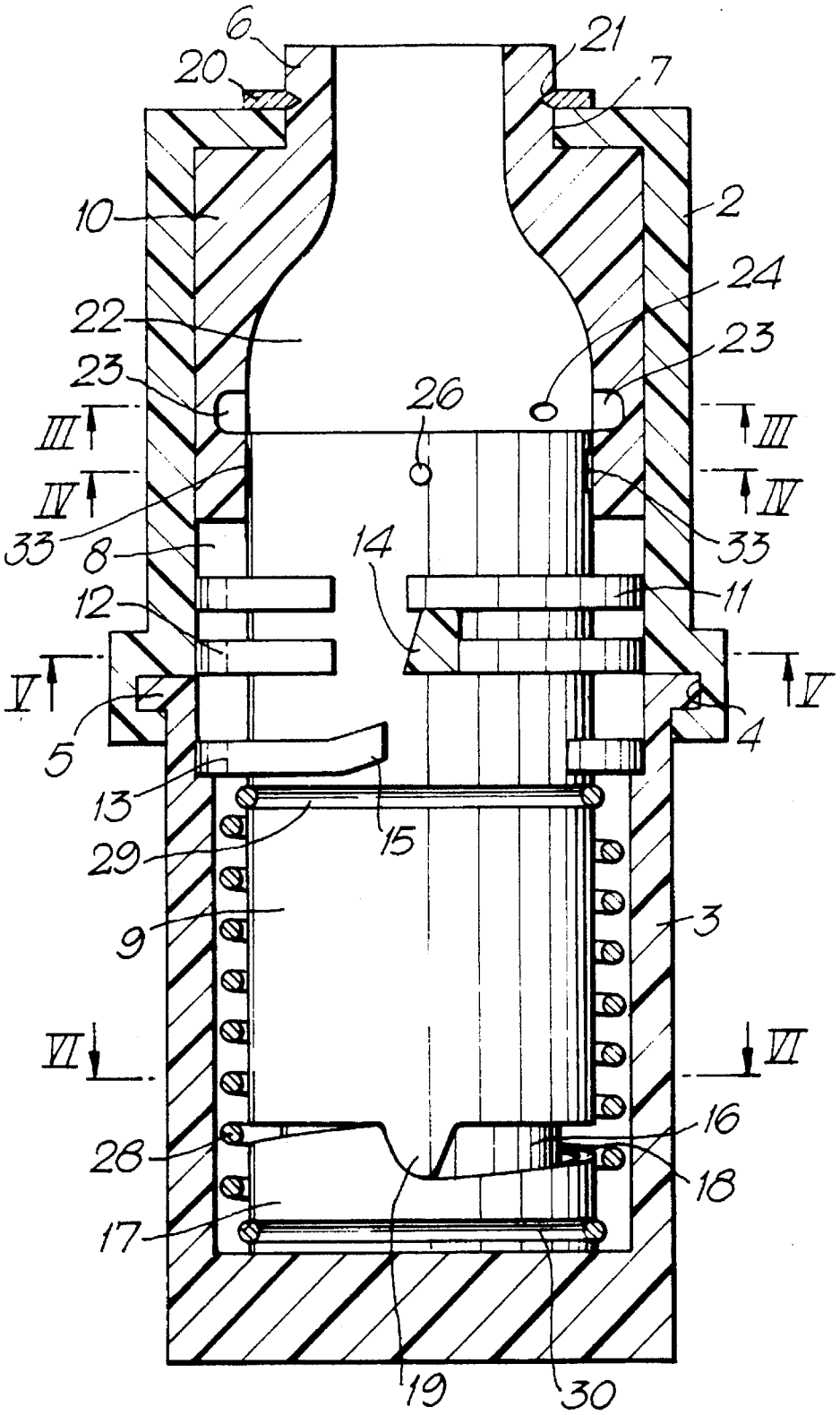
FIG. 2 is an A to A cross-sectional view of FIG. 1.
Figure 3:
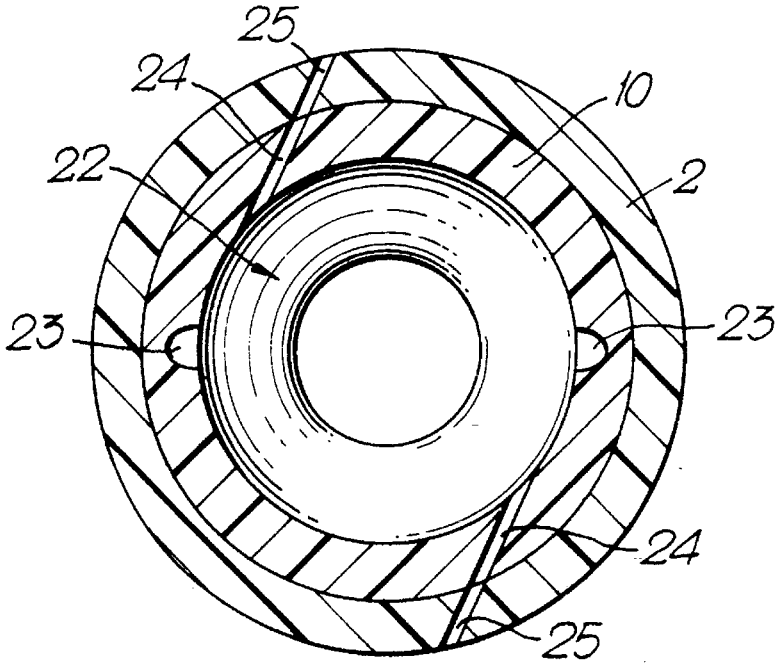
FIG. 3 is an outline view explaining one preferred embodiment of the present invention.

As shown in FIG. 3, one end of a corrugate pipe 28 is fastened by a fixed head 26 fixed in a circular fixed head table 24 so that a circular moving chuck table 30 whose diameter is the same as that of the fixed head table 24 is rotated in contact with the fixed head table 24 and the other end of the corrugate pipe 28 is fixed to a moving chuck 32 which is fastened to the moving chuck table 30. The corrugate tube 28 is made of aluminium alloy (JIS A3003) whose crest diameter is 18.3 mm, whose trough diameter is ϕ12.7 mm, whose pitch is 9.5 mm and whose thickness is 1.2 mm.

Figure 4:
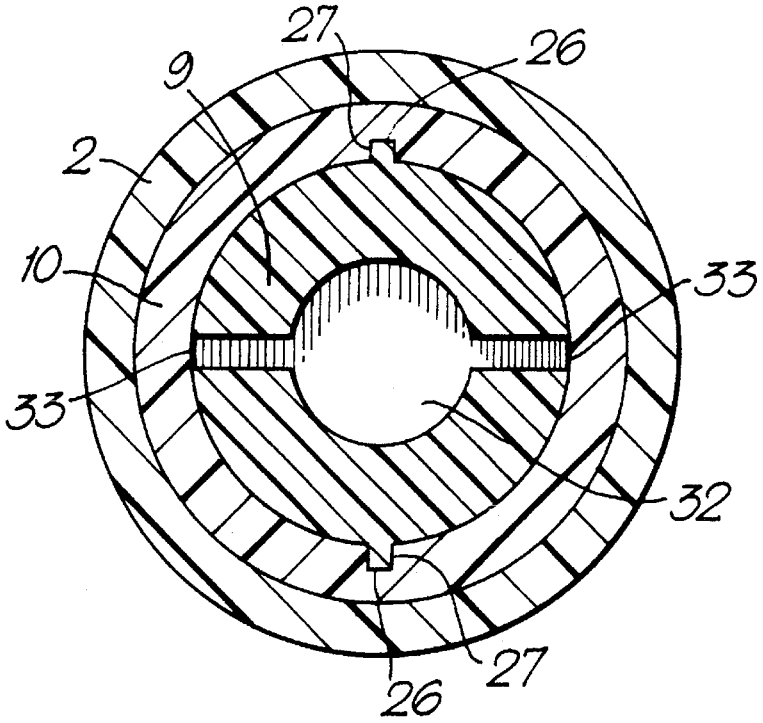
FIG. 4 is an cross-sectional view of a corrugate tube which was bent by the preferred embodiment of the present invention.

Next, the moving chuck table 30 is rotated around the fixed head table 24 as it being in contact with the fixed head table 24 so that the bending the corrugate tube was conducted. The bending conditions were as follows: R=18 mm and the bending velocity=36 deg/s. The cross-sectional view at the bent portion is shown in FIG. 4. In the conventional bending of the corrugate tube, the convex portion winds and this cause the failure in working. On the other hand, at both of bent inside area 34 and bent outside area 36 of the bent portion in the present preferred embodiment, flexuous failure was hardly generated and the uniform bending R was obtained. The compressed ratio at a pipe inside 38 was 8% and the ratio of reduction in thickness was 2%. The above-mentioned result is at the sufficient level and it is the more improved result compared with that in general method for bending a straight pipe. Here, the ratio of compression is calculated as follows: the difference between the long diameter and the small diameter at the compressed portion is divided by the mean diameter and then, the result is multiplied by 100 so that the ratio is obtained. Also the thickness reduced ratio is the amount which is measured at the trough portion (the portion having a small diameter) at the centrifugal side where the thickness is mostly reduced.

Figure 5:
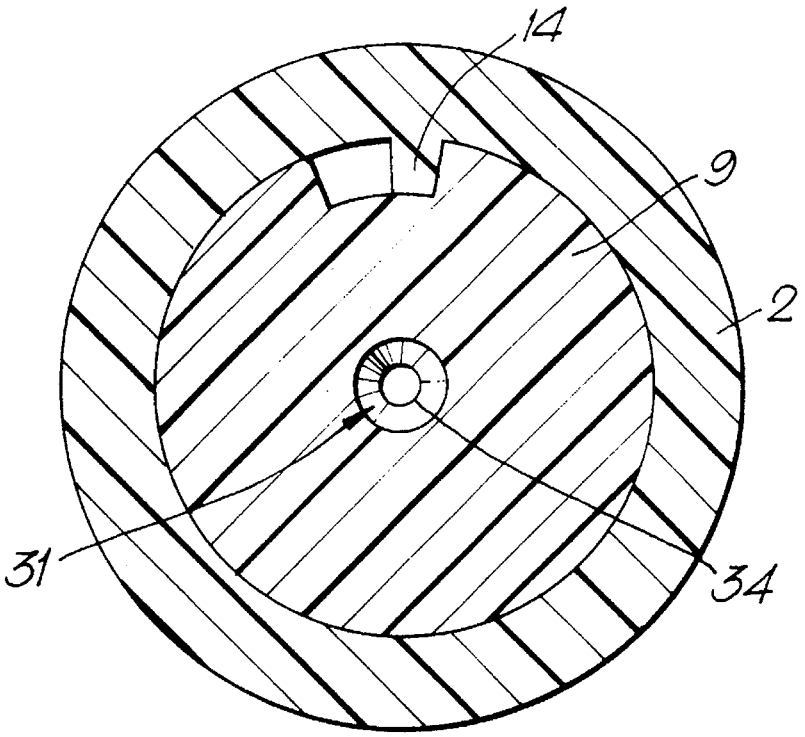
FIG. 5 is a side view showing the bending result when the ratio of autorotation and revolution is varied in the present invention.
Figure 6:
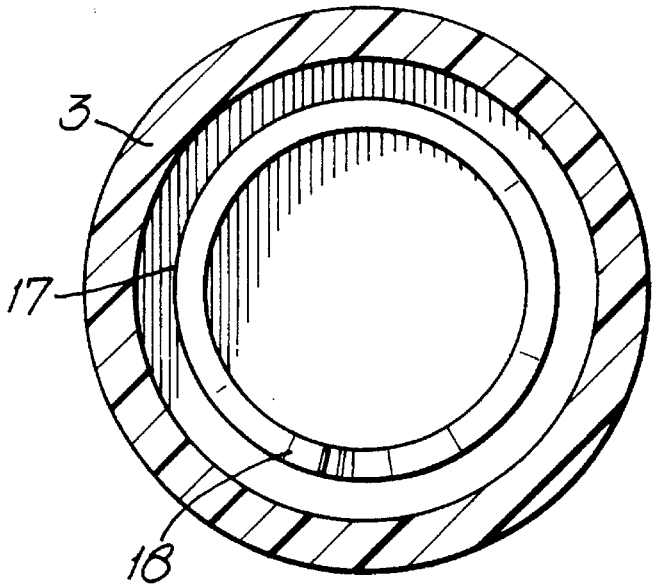
FIG. 6 is a side view showing the bending result when the ratio of autorotation and revolution is varied in the present invention.
Figure 8:
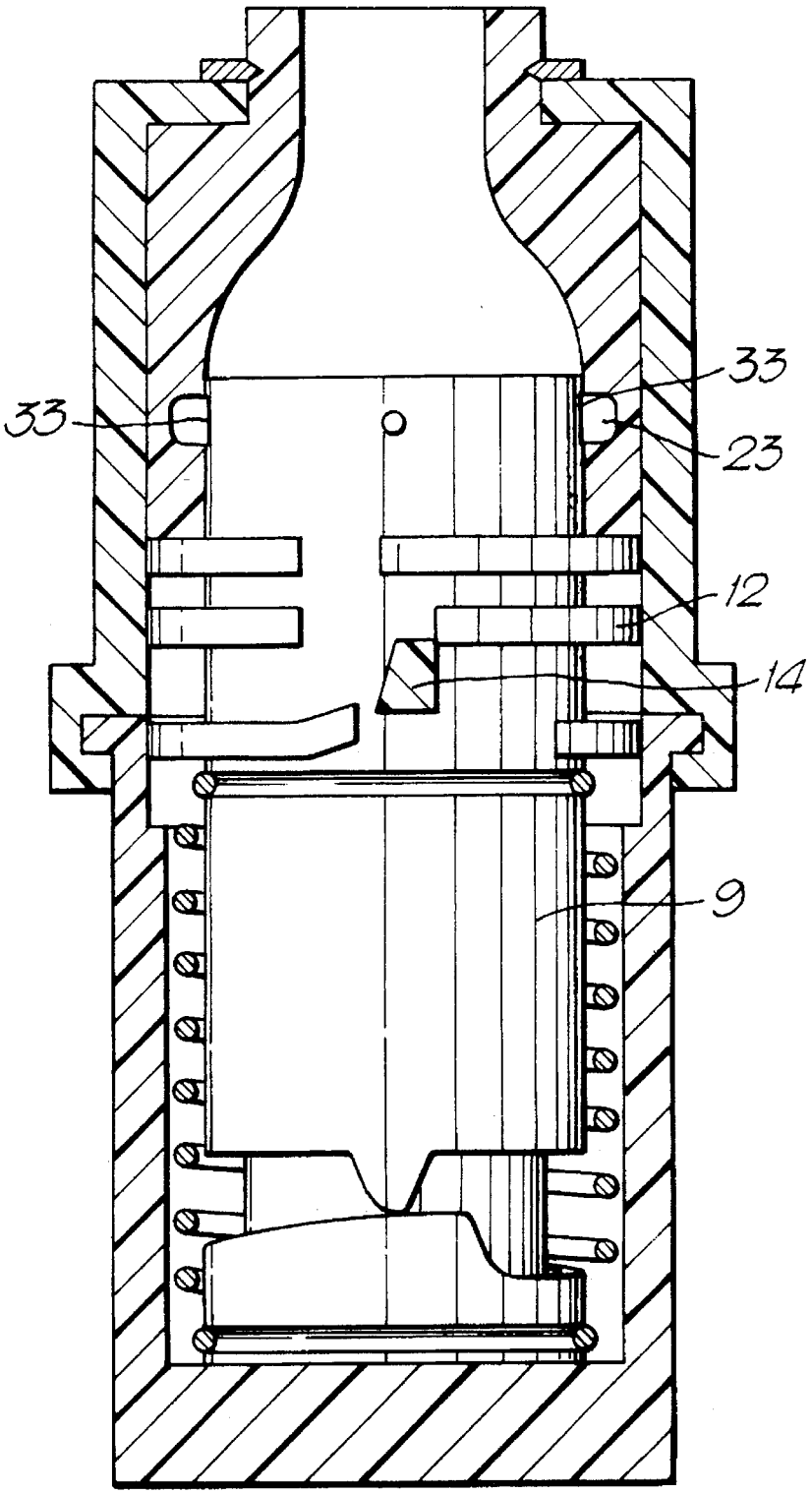
FIG. 8 is a B to B cross-sectional view of FIG. 7.

In the present invention the angular velocity ratio of revolution and autorotation is preferably set to be 1 to 2 theoretically as mentioned above. However, in the actual application, it is possible to set the extent being from through 1:1.5 to 1:2.5. In that case, the curvature varies to the extent that the ratio is shifted from that theoretical amount. If the revolution velocity becomes faster, the curvature at the fixed side is raised as shown in FIG. 5 and if the autorotation velocity becomes faster, the curvature at the moving side is raised as shown in FIG. 6.

Next, the preferred embodiment in the present apparatus for bending a pipe will be explained with reference to FIG. 9, as follows. A pipe fixed side 11 is grasped and arrested by the fixed head 26 and a pipe moving side 12 is grasped and arrested by the moving chuck 32. A revolution axis 42 is provided vertically and downward at the revolution center of the moving chuck 32 which is positioned at a fixed arm 40 supporting the fixed head 26. On the other hand, an autorotation axis 46 is fastened downward at the autorotation center of a moving arm 44 which supports the moving chuck 32. Gears 48 and 50 are mounted on these revolution axis 42 and autorotation axis 46 respectively and these gears 48 and 50 engage each other.

The revolution axis 42 is fastened, however, the autorotation axis 46 is driven by a drive source which is not shown in the figure. Accordingly, the moving chuck 32 rotates on its axis having the turning radius to be the radius of the gear 50 and at the same time, the moving chuck 32 revolves having the turning radius to be the sum of the radius of the gear 48 and the radius of the gear 50. FIG. 10 is a squint-eyed view showing the state in which the moving chuck 32 is rotated at the angle of 180°. FIG. 11 is a squint-eyed view showing the state in which the moving chuck 32 is rotated at the angle of 90°.

Another preferred embodiment of the present apparatus for bending a pipe is shown in FIGS. 12 to 15. FIG. 12 is a view showing the whole of this preferred embodiment of the apparatus for bending a pipe. The apparatus for bending of this embodiment can simultaneously bend both edges of a corrugate pipe having arbitrary length and also can change the radius of curvature at bending. FIG. 12, a machine stand 52 is assembled by using square timbers in rectangular parallelopiped shape and before and behind surfaces are covered by side plates 54 and 54. On the machine stand 52, two guide rails 58 and 58 are supported by a guide support 56.

On these two guide rails, pipe bending mechanism portions 60 and 60 are mounted on both edges and a pipe supporting portion 62 is mounted on the middle thereof. The pipe bending mechanism portions 60 and 60 are connected to two ball screws 64 and 64 which are axially supported by the side plates 54 and 54 at before and behind surfaces and they are moved back and forth by a motor for moving a bending mechanism 66 which drives these ball screws 64 and 64.

A squint-eyed view showing details of the pipe bending mechanisms 60 and 60 is as shown in FIG. 13. A first base plate 68, which is at the uppermost, is mounted being movable back and forth on a guide rail 58 through four guides 70 which are mounted on the bottom thereof. Under this first base plate 68, a second base plate 72 is suspended and fasted by four rods. Furthermore, under this second base plate 72, a fourth base plate 74 is suspended and fastened by four rods.

Also, between the second base plate 72 and the fourth base plate, a third base plate 78 is mounted being able to go up and down through four linear bushes 76 which are mounted on the rod for suspending as it can go up and down. This third base plate 78 goes up and down by a cylinder 80 for going arm up and down which is mounted between the fourth base plate 74 and the third base plate 78.

The constructions of a fixed arm 40 and a moving arm 44 are shown in FIGS. 13 and 14. Inside thereof, a chuck switch cylinders 82 and 82 are included and they open and close the fixed head 26 and the moving chuck 32. The fixed arm 40 is installed by fastening the revolution axis 42 to the first base plate 68. The bottom end of the revolution axis 42 passes through the second base plate and the bottom end thereof reaches to the third base plate.

The revolution axis 42 on the first base plate 68 is passed through by the rotation axis 46 and it is provided with a long hole 84 which can approach to or depart from the revolution axis 42. At the revolution axis 42, there are provided a first connecting member 86 whose one end is pivotally and rotatably attached to the revolution axis 42, a second connecting member 88 which is pivotally attached to the revolution axis 42 on the second base plate 72 and whose structure is similar to that of the first connecting member and a third connecting member 90 which is mounted on the third base plate 78 and whose structure is similar to that of the first connecting member. The autorotation axis 46 of the moving arm 44 is passed through the long holes 84 for each of three connecting members 86, 88 and 90 so as to connect the moving arm 44 to the fixed arm 40.

The second connecting member 88 is in a box shape. Small-diameter gear pair 91 which are fastened to the revolution axis 42 and rotation 46 are included in the second connecting member. And at the same time, from the rotation axis 46 side toward the revolution axis 42, a gear connecting cylinder 92 is mounted on the second connection member. Therefore, depending on the size of the gear pair mounted on the revolution axis 42 and the autorotation axis 46, the autorotation axis 46 is moved forward and back.

The constructions of the revolution axis 42 and the autorotation axis 46 are shown in FIG. 14. As shown in FIG. 14, just under the second connecting member 88, the revolution axis 42 and the autorotation axis 46 can be separated. By lowering the third base plate by operating a cylinder 80 for moving arm up and down, the revolution axis 42 and rotation axis 46 can be separated. At the top end of the separated revolution axis 42*a* and rotation axis 46*a*, a spline is provided and at the same time, at the position which is lowered in response to the height of the gear, a gear stopper 47 is provided.

On the other hand, at both side of the second base plate 72, guide rail for pallets 94 and 94 are provided. A middle-diameter gear pallet 102, to which a middle-diameter gear pair 96 and 96 are locked and fastened from one side by using a gear look 98 and a gear lock cylinder 100, goes forward and back by a middle-diameter gear moving cylinder lob on the surface thereof. From the other side, a large-diameter gear pallet 112, to which a large-diameter gear pair 106 are locked by using a gear lock 108 and a large-diameter gear lock cylinder 110, goes forward and back by a large-diameter gear moving cylinder 114. At center holes of the middle-diameter gear and the large-diameter gear, splines are provided respectively.

The bottom ends of the revolution axis 42 and the rotation axis 46 are supported by a turntable 116 which revolves around the revolution axis 42 attached to the third base plate 78. The rotation axis 46 is connected with a driving motor 122 through a universal joint 118 and and a gear box 120.

Next, the detail of the pipe supporting portion 62 is shown in FIG. 15. An arm 126 is provided standing on a base plate 124. In this arm 126, a chuck cylinder 130 is installed so as to open and close chuck cases 128. In these chuck cases 128, chuck pieces 134 are installed through bearings 132. These chuck pieces 134 can rotate the chucked pipe on the surface which is perpendicular to the axis thereof and driven gears 136 are installed on one end of the chuck pieces.

A gear box 140 is installed on the reverse side on which the arm 126 of the base plate 124 is standing. Through a coupling 142, a rotating motor 143 is connected to the front face of this gear box 140. At the output axis of the side surface of the gear box 140, a lower side pulley 144 is amounted. Between an upper side pulley 146 mounted on the upper portion side surface of the arm 126 and the lower side pulley, a timing belt 148 is wound so that the rotation of the lower side pulley 144 is transmitted to the upper side pulley 146. A drive gear 150 is fastened to the axis which is coaxial to the upper side pulley 146. This drive gear 150 engages the drive gears 136 and 136 of the chuck pieces 134 and 134. Accordingly, in response to the rotation of the drive gear 150, the chuck pieces 134 and 134 rotate.

The operation of this preferred embodiment having the above-mentioned construction will be explained. In the apparatus of FIG. 12, the pipe which will be worked is grasped by the pipe supporting portion 62 at first. The detail of the pipe supporting portion 62 is shown in FIG. 15. First, the pipe is passed through between the chuck pieces 134 in the state in which the chuck cases 128 are opened. Next, the chuck cylinder 130 which is included in the arm 126 is operated so that the chuck cases 128 are closed and the chuck pieces 134 grasp the pipe.

Next, when it is necessary to bend the the grasped pipe into the desired bent surface, the followings operation is conducted. The rotating motor 143 is operated so that the lower side pulley 144 is rotated through the coupling 142 and the gear box 140. Then the upper side pulley 146 is rotated by the timing belt 148 so that the drive gear 150 which is mounted coaxially is rotated. By the rotation of the driven gears 136, which engage the drive gear 150, of the chuck pieces 134, the pipe grasped in the chuck pieces 134 are rotated so that the desired bent surface can be obtained by amending.

At this time, the fixed head 26 and the moving chuck 32 of the pipe bending mechanism are in the opened state. When the bending mechanism 60 is not positioned in the desired pipe bending position, as shown in FIG. 12, the motors for moving bending mechanisms 66 rotate ball screws 64 and 64 and they set the bending mechanism 60 to the predetermined position.

Next as shown in FIG. 13, a gear connecting cylinder 92, which is mounted on the second connecting member 88, is operated so that the rotation axis 46 is moved toward the revolution axis 42. Then, because the rotation axis 46 moves inside of the long hole 84 for three connecting members, the small-diameter gear pair 91, which are fastened to the revolution axis 42 and rotation axis 46, engage at the inside of the second connecting member 88.

When the small-diameter gear pair 91 engage each other, the cylinder for opening and closing chuck 82, which is amounted on the fixed arm 40 and the moving arm 44, is operated so that the pipe is grasped and arrested by the fixed head 26 and the moving chuck 32. Next, the drive motor 122 is driven, because the drive motor 122 is connected to the rotation axis 46 through the gear box 120 and the universal joint 118, as the moving chuck 32 which grasps and arrests the pipe rotates around the rotation axis 46 and setting the rotational radius to be the radius of the small-diameter gear 91, this moving chuck 32 revolves setting the rotational radius to be the sum of the radius in the small-diameter gear pair 91. Therefore, the bending is conducted by the method of the present invention.

Next the exchange the small-diameter gear pair 91 for the middle-diameter gear pair 96 and 96 or the large-diameter gear pair 106 will be explained as follows. As shown in FIGS. 12 and 13, in the state in which the fixed heads 26 and the moving chuck 32 are opened, a gear connecting cylinder 92 is operated and the space between the revolution axis 42 and the rotation axis 46 is set to conform to the space of the center hole of the a gear pallet 102, a middle-diameter gear pair 96 contained in 112 or the large-diameter gear pair 106.

Next, when the cylinder 80 for going arm up and down is operated so as to lower the third base plate 78, the revolution axis 42 and the rotation axis 46 are separated up and down just under the second connecting member 88 and cause the clearance. Subsequently, a cylinder for moving middle-diameter gear pallet 104 or a cylinder for moving large-diameter gear pallet 114 is operated and the middle-diameter gear pallet 102 or the large-diameter gear pallet 112 is moved so that the center hole of the gears is set to conform to the core of the revolution axis 42 and the rotation axis 46.

Secondly, when a middle-diameter gear lock cylinder 100 or a large-diameter gear lock cylinder 110 is operated, a gear lock 98 or 108 is disengaged and at the same time the cylinder for going arm up and down 80 is operated so that the third base plate 78 is pushed up, the following will occur: the separated revolution axis 42 and the rotation axis 46*a* rise and after the spline portion at the tip portion is passed through by the center hole of the middle-diameter gear 96 or the large-diameter gear 106, it will be engaged to the revolution axis 42 and the rotation axis 46 as before.

If the middle-diameter gear pallet 102 or the large-diameter gear pallet 112 is operated and it is put back where it was, the exchange of gear pair is accomplished. Accordingly, if the cylinder for connecting gear 92 is operated and the exchanged gears are engaged each other so that bending a pipe is conducted in the same way as mentioned above, bending a pipe having different rotational radius will be executed.

In order to put the exchanged gear pair in the former state, the following should be operated: a cylinder for connecting a gear 92 is operated; after the rotation axis 46 and the revolution axis 42 are separated from each other at the space where the gear pair can be contained in the gear pallet 102 or 112; the gear pair are contained in the gear pallet 102 or 112 and the gear is locked by a gear lock cylinder 100 or 110 and at the same time, the third base plate is lowered by the cylinder for going arm up and down 80 and the revolution axis 42 and rotation axis 46 are separated and extracted from the gear; and the gear pallet 102 or 112 in which the gear pair 96 and 96 or 106 are contained is put back where it was by the cylinder 104 or 114.

FIG. 16 is a squint-eyed view showing an outline of the apparatus of another preferred embodiment. At the machine base 152, the fixed arm 40 is provided being stood by a stay 154 and at the top end thereof the fixed heads 26 are installed. At both sides of the machine base 152, two rails for X-axis 156*a* and 156*b* are provided in parallel, and a rail for Y-axis 158 is laid across over these axes. This Y-axis rail 158 is moved to the desired position on the X-axis by X-axis servo-motor 160.

At the Y-axis rail 158, the sliding member 162 is engaged slidably and by the Y-axis servo-motor 164, the sliding member 162 can move to the desired position on the Y-axis rail 158. At this sliding member 162, a rotation axis 46 is pivotally attached being perpendicular and at the top portion thereof, the moving arm 44 and the moving chuck 32 are fastened. Also, at the lower part thereof, a Z-axis servo-motor 166 is directly connected. By this Z-axis servo-motor 166, the rotation axis 46 can rotate on its axis st the desired angle.

FIG. 17 shows an apparatus which a pipe supporting portion 62 is added to the apparatus of the preferred embodiment shown in FIG. 16. Namely, at the middle of rear half of the machine base 152, a pipe feed rail 168 is provided so as to run across the machine base 152 longitudinally. And at this pipe feed rail 168, the pipe supporting portion 62 is mounted being able to move back and forth. This pipe supporting portion 62 moves back and forth by a pipe feed motor 170.

The pipe supporting portion 62 has the same construction as that shown FIG. 15: it comprises an arm 126 and chuck pieces 134 which are mounted on the top end thereof. By a motor for rotating a pipe 143, the chuck pieces 134 rotates the grasped pipe.

The operation of the apparatus of the preferred embodiment shown in FIG. 17 will be explained as follows. The pipe is grasped by the chuck piece 184 of the pipe supporting portion 62 at first. At this time, the fixed head 26 and the moving chuck 32 are both in opened state. Next, a motor for rotating a pipe 143 of the pipe supporting portion 62 is operated so as to rotate the chuck piece 134 and the pipe for bending is set to conform to the desired pipe bending surface. If the pipe bending surface is conformed, next by a pipe feed motor 170 the pipe supporting portion 62 is moved back and forth on the pipe feed rail 168 so as to adjust the portion which is desired to be bent to be positioned at the fixed head 26 of the pipe bending mechanism.

Secondly, a X-axis servo-motor 160 is operated, a Y-axis rail 158 is moved on X-axis rails 156*a* and 156*b* and a moving arm 44, which is mounted on a Y-axis rail, is moved so as to adjust the revolution center in the fixed arm 40 to be apart from the rotation axis 46 in the moving arm 44 as far as the desired revolution radius. If the rotation axis 46 is apart from as far as the desired revolution radius, the fixed head 26 and the moving chuck 32 are closed and after grasping and arresting the bending pipe, the X-axis servo-motor 160 and the Y-axis servo-motor 164 are operated at the same time and the Y-axis rail 158 on the X-axis rails 156*a* and 156*b* and the Y-axis rail 158 on the sliding member 162 are moved. Then, the X-axis servo-motor 160 and the Y-axis servo-motor 164 are controlled by the control means (not shown in the figure) so that the rotation axis 46 attached to the sliding member 162 moves at the set desired revolution radius.

On the other hand, a Z-axis servo-motor which is directly connected with the rotation axis 46 rotates the rotation axis 46 on its axis in response to the revolution angle by the control means which is not shown in the figure. Accordingly, the pipe secured by the moving chuck 32 rotates on its axis at the predetermined rotation radius. As the result, bending a pipe by using the method of the present invention can be conducted within the desired bending surface and at the desired radius of curvature.

Having now fully described the present invention, it will be apparent to one of ordinary skill in the art that many changes and modifications can be made thereto without departing from the spirit or scope of the present invention as set forth herein including the appended claims.

We claim:

1. A method for bending a pipe, the pipe having a longitudinal axis, the method comprising:

holding a pipe on opposite sides of a bending portion; and revolving one side of the pipe relative to the other side of the pipe around a revolving axis having a point on the longitudinal axis of the pipe, while simultaneously rotating the one side of the pipe around a rotation axis having a point on the longitudinal axis of the pipe, wherein the other side of the pipe is held stationary with respect to the one side of the pipe.

2. A method according to claim 1, wherein the revolving of the one side is with an angular revolution velocity, and the rotating of the one side is with an angular rotation velocity, a ratio of the angular revolution velocity to the angular rotation velocity being in a range from about 1:1.5 to 1:2.5.

3. A method according to claim 1, wherein the pipe is a corrugated pipe.

4. An apparatus for bending a pipe, the pipe including a bending portion having opposite sides, the apparatus comprising:

a pair of grasping portions that holds the opposite sides on the pipe; and a drive assembly comprising:

a revolution drive unit that defines a revolution axis for one side of the pipe, the revolution drive device including one of the pair of grasping portions, the revolution drive device revolving the one of the pair of grasping portions around the revolution axis to bend the one side of the pipe; and a rotation drive unit that defines a rotation axis for the one side of the pipe, the rotation drive device rotating the one of the pair of grasping portions around the rotation axis to rotate and to bend the one side of the pipe, wherein the other side of the pipe is held stationary with respect to the one side of the pipe.

5. An apparatus according to claim 4, wherein the drive assembly further comprises:

a first external tooth gear being generally coaxial with the revolution axis;

a second external tooth gear being generally coaxial with the rotation axis, the second external tooth gear being engageable with the first external tooth gear; and a rotational drive unit that rotates and drives the second external tooth gear, the first external tooth gear engages the second external, tooth gear, the first external tooth gear also rotated by the rotational drive unit.

6. An apparatus according to claim 5, wherein the first external tooth gear has a diameter substantially equal to a diameter of the second external tooth gear.

7. An apparatus according to claim 5, wherein the first external tooth gear has a diameter that is different from a diameter of the second external tooth gear.

8. An apparatus according to claim 4, wherein the revolution drive unit further comprises an arm having a central axis coaxial with the revolution axis, the arm including the one of the pair of grasping portions, and a first motor that rotates the arm around the central axis; and the revolution drive unit further comprises a second motor positioned at the arm for revolving the one of the pair of grasping portions; and a control unit that controls a speeds of the first and the second motors.

9. An apparatus according to claim 8, wherein the control device controls speeds of the first motion and the second motor to define a uniform ratio of the speed of the first motor to the speed of the second motor.

10. An apparatus according to claim 8, wherein the arm has an adjustable length.

11. An apparatus according to claim 4, wherein the revolution drive unit comprises:

a two-dimensional drive unit that moves in a first direction and a second direction, wherein the first direction is perpendicular to the second direction and parallel to the revolution axis and rotation axis; and a controller controls the two-dimensional drive unit.

12. An apparatus for bending a pipe, the pipe defining a longitudinal axis and including a bending portion having opposite sides, the apparatus comprising:

an first axis;

an arm rotatably, coaxially held on the first axis and defining a rotation axis parallel to the first axis;

a rotating, grasping portion that holds the one side of the bending portion, the rotating, grasping portion being fixed with the rotation axis so the longitudinal axis of the pipe at an other side of the bending portion is positioned with a point on the rotation axis;

a fixed, grasping portion that holds the other side of the bending portion spaced from one side of the bending portion, the fixed grasping portion being fixed to the first axis so the longitudinal axis of the pipe between a held portion and the bending portion is positioned with a point on the first axis;

a first gear concentrically positioned first axis;

a second gear being engageable with the first gear and rotating with the rotation axis; and a drive unit that rotates the rotation axis to bend the one side of the bending portion of the pipe around the first axis.

13. An apparatus for bending a pipe, the pipe defining a longitudinal axis and including a bending portion having opposite sides, the apparatus comprising:

a first axis;

an arm rotatably held spaced from the first axis and defining a rotation axis;

a rotating, grasping portion that holds one side of the bending portion, the rotating, grasping portion being fixed to the rotation axis so the longitudinal axis of the pipe at the bending portion is positioned having a point on the rotation axis;

a fixed, grasping portion that holds an other side of the bending portion spaced from the one side of the bending portion, the fixed, grasping portion being fixed to the first axis so a longitudinal axis of the pipe is positioned having a point on the first axis;

a rotation axis drive device cooperating with the arm and rotatably holding the rotation axis parallel to the fixed axis, the rotation axis drive device moving the rotation axis toward and away from the fixed axis;

a drive device that rotates the rotation axis, wherein the other side of the pipe is held stationary with respect to the one side of the pipe; and at least two pair of engageable gears, wherein the at least two pair of engageable gears includes at least two external gears that engage each other, and at least a fixed pair of gears movable away from and towards the at least two external gears as the rotation axis drive device moves the rotation axis.

14. An apparatus according to claim 13, wherein the two external gears have different diameters.

15. An apparatus for bending a pipe, the pipe defining a longitudinal axis and including bending portions having opposite sides, the apparatus comprising:

a base;

a first axial drive unit supported on the base, the first axial drive unit reciprocating in a first axial direction;

a second axial drive unit supported by the first axial drive unit moveable in a direction both perpendicular to the first axial direction and parallel to the longitudinal axis of the pipe;

a rotation axis rotatably held by the second axial drive unit;

a rotation drive unit that for rotates and drives the rotation axis; and a rotating, grasping portion that holds the one side of the bending portion, the rotating, grasping portion being fixed to the rotation axis so the longitudinal axis is on the rotation axis;

a fixed, grasping portion that holds another side of the pipe at the bending portion spaced from the one side of the bending portion, the fixed grasping portion being fixed to the base; wherein the rotation drive devices rotates the rotation axis to rotate the rotating, grasping portion and to bend the pipe.

* * * * *